US007875760B2

(12) United States Patent
Cho et al.

(10) Patent No.: US 7,875,760 B2
(45) Date of Patent: Jan. 25, 2011

(54) REUSE METHOD OF RADIOACTIVE WASTE SALT AND THE APPARATUS THEREOF

(75) Inventors: Yung-Zun Cho, Daejeon (KR); Hee-Chul Yang, Daejeon (KR); Hee-Chul Eun, Daejeon (KR); In-Tae Kim, Daejeon (KR); Han-Soo Lee, Daejeon (KR); Hwan-Seo Park, Daejeon (KR)

(73) Assignees: Korea Atomic Energy Research Institute, Daejeon (KR); Korea Hydro & Nuclear Power Co., Ltd., Seoul (KR)

( * ) Notice: Subject to any disclaimer, the term of this patent is extended or adjusted under 35 U.S.C. 154(b) by 212 days.

(21) Appl. No.: 12/216,014

(22) Filed: Jun. 27, 2008

(65) Prior Publication Data

US 2009/0005628 A1 Jan. 1, 2009

(30) Foreign Application Priority Data

Jun. 29, 2007 (KR) ..... 10-2007-0065134

(51) Int. Cl.
*G21F 9/14* (2006.01)

(52) U.S. Cl. ..... 588/18; 423/11; 588/300

(58) Field of Classification Search ..... 588/18, 588/300; 423/11
See application file for complete search history.

(56) References Cited

U.S. PATENT DOCUMENTS 5,505,823 A * 4/1996 Rendall ..... 205/354

OTHER PUBLICATIONS

Cho, Yong-Jun, Characteristics of Oxidation Reaction of Rare-earth Chlorides for Precipitation in LiCI-KCI Molten Salt by Oxygen Sparging, Journal of Nuclear Science and Technology, vol. 43, No. 10, p. 1280-1286 (2006).*

Garcia, Eduarco, Salt Distillation, Los Alamos Science, No. 26, 449 (2000).*

Hee-Chul Yang et al., "Behavior of Radioactive Metal Surrogates Under Various Waste Combustion Conditions", *Journal of the Korean Nuclear Society* vol. 34, No. 1, Feb. 2002, pp. 80-89.

A.S. Wagh et al., "Stabilization of Rocky Flats Pu-contaminated ash within chemically bonded phosphate ceramics", *Journal of Nuclear Materials* 265 (1999) 295-307.

(Continued)

*Primary Examiner*—Melvin C Mayes
*Assistant Examiner*—Melissa Stalder
(74) *Attorney, Agent, or Firm*—Clark & Brody

(57) ABSTRACT

A reuse apparatus of eutectic salt waste produced in an electro refining process and a method thereof is a technology that in order to collect the eutectic salt of the eutectic salt waste, oxidizes/precipitates nuclides (rare earth and TRU) within the eutectic salt waste, an oxygen dispersing method is used to perform a layer separation into the eutectic salt layer and the precipitate layer. Then, the precipitate layer and eutectic salt layer are separated and collected, so that the eutectic salt layer is directly reused and the eutectic salt within the precipitates is reused by separating and collecting it using distillation/condensation processes. The reuse apparatus of the eutectic salt waste and a method thereof thereby increases the collecting efficiency of the eutectic salt and allows the compositions of the collected eutectic salt to have the same compositions as the eutectic salt used in the electro refining process.

4 Claims, 3 Drawing Sheets

OTHER PUBLICATIONS

T. Kawata et al., "Preliminary Study on the Partitioning of Transuranium Elements in High Level Liquid Waste", *First OECD/NEA Information Exchange Meeting on Separation and Transmutation of Actinides and Fission Products*, Mite, Japan, Nov. 6-9, 1990.

* cited by examiner

REUSE METHOD OF RADIOACTIVE WASTE SALT AND THE APPARATUS THEREOF

TECHNICAL FIELD

The present invention relates to a reuse apparatus of eutectic salt waste produced in an electro refining process.

BACKGROUND ART

LiCl13 KCl eutectic salt waste including rare earth and TRU nuclides is produced in an electro refining process of spent oxide fuel. The reuse of the salt waste suddenly reduces an amount of waste to be finally processed, thereby very significantly affecting the excellence and economical efficiency of the electro refining process.

To reuse the salt waste, the nuclides (rare earth and TRU) included in the salt waste should first be separated. To this end, the related art has used a method of precipitating the nuclides into oxide by using oxidants $Li_2O$, $V_2O_5$, etc., or precipitating them into carbonate or phosphate by adding precipitants $Na_2CO_3$, $Li_3PO_4$.

However, in the case of using the oxidants or the precipitants as in the related art, since it is difficult to separate the oxidants or the precipitants added above an equivalent and the eutectic compositions of LiCl—KCl are changed due to byproducts produced in oxidation reaction and precipitation reaction, it is very difficult to separate and reuse a pure LiCl—KCl eutectic salt.

Today, any other countries have not developed a reuse technology of the eutectic salt waste produced in the electro refining process; however, to reduce an amount of high-level radioactive waste to be finally processed, are developing a process of separating only the precipitates by precipitating the nuclides within the eutectic salt waste using the oxidants $V_2O_5$ and then distilling/condensing the entire eutectic salt waste. In this case, the entire eutectic salt waste should be distilled so that the operational costs of the distillation process are very high and the collected eutectic salt cannot be reused.

As a method of precipitating rare earth elements existing in the eutectic salt waste. A research result of using phosphoric acid $Li_3PO_4$ or oxidant $Li_2O$ has been published; however, it is difficult to reuse the eutectic salt even in the case of using this method.

In order to solve the aforementioned problems, the present provides a reuse apparatus of LiCl—KCl eutectic salt waste and a method thereof, which performs a layer separation into a pure salt layer and a precipitate layer by precipitating the nuclides including rare earth and TRU within the LiCl—KCl eutectic salt waste into oxide or oxychloride through a reaction with oxygen, without using the precipitants such as the oxidants, etc. and then separate the pure salt layer from the precipitate layer using siphons, and directly reuses the pure salt layer in the electro refining process and collecting and reusing the eutectic salt existing in the precipitate layer using volatilization and condensation processes.

DISCLOSURE OF THE INVENTION

It is an object of the present invention to provide an apparatus capable of collecting and reusing eutectic salt of eutectic salt waste including nuclides and a method thereof. It is another object of the present invention to provide an oxidation apparatus that effectively completes oxidation reaction of nuclides including rare earth and TRU using oxygen for a short time.

In an apparatus for oxidizing and separating nuclides of eutectic salt waste including the nuclides, an oxidation apparatus 100 of the present invention oxidizing the nuclides comprises a cone-type reactor 110 becoming narrow as going down, a heater 140, and an oxygen supplying pipe 120 having a diffuser 121 positioned at a lower surface of the reactor, wherein oxygen is supplied to the reactor 110 through the oxygen supplying pipe 120 and the reactor 110 is heated by the heater 140 to produce oxide, oxychloride, or oxide and oxychloride of the nuclides including rare earth and TRU within the eutectic salt waste put in the reactor 110 and then, to leads to a layer separation of a precipitate layer and an eutectic salt layer formed on the upper of the precipitate layer by free settling.

Preferably, the reactor 110 in the oxidation apparatus 100 is sealed with an airtight wall (130). Preferably, the heater 140 is provided to the outside of the sealed reactor 110. The oxidation apparatus 100 may further include a gas discharging pipe 150 for controlling atmosphere, pressure or discharging gas. The oxidation apparatus 100 may further include collecting pipes 300 and 400 for separating and collecting the precipitate layer including oxide, oxychloride, or oxide and oxychloride and the eutectic salt layer formed on the upper of the precipitate layer by precipitating of oxide, oxychloride, or oxide and oxychloride of the nuclides.

The diffuser 121 is radially provided with a tube-type blade whose surface is formed with a plurality of holes, the holes discharging oxygen injected from one side of the oxygen supplying pipe 120. Also, the upper of the oxygen supplying pipe 120 may further be provided with a circular plate 122. When injecting oxygen flux required for oxidation into the eutectic salt waste, a porous oxygen supplying pipe 120 is used to produce bubbles (oxygen) with smaller and more uniform size than in using the existing vertical pipe, making it possible to minimize a discharge phenomenon. Also, although slightly oxidized rare earth and TRU are discharged, they are attached to the circular plate 122 mounted on the upper of the oxygen supplying pipe 120 without being discharged to the outside of the reactor, making it possible to minimize the discharge to the outside thereof.

The reactor 110 is most preferably the cone type becoming narrow as going down, upon considering uniform dispersion of oxygen and uniform oxidation reaction, but a polygonal horn-type reactor becoming narrow as going down may be used. Also, the holes may be formed on the entire surface of the tube-type blade configuring the diffuser 121 and preferably, more than two blades are radially provided. More preferably, three to eight blades are radially provided to configure the diffuser.

The core of the reuse apparatus of the eutectic salt waste including the oxidation apparatus uses the oxygen supplying pipe having the diffuser that has stabilized dispersion characteristic to disperse more flux, uses the cone-type reactor becoming narrow as going down, uses oxygen supplied from the oxygen supplying pipe to produce oxide, oxychloride, or oxide and oxychloride of the nuclides, allows eutectic salt waste in the reactor to use gravity to perform the layer separation into the precipitate layer including oxide, oxychloride, or oxide and oxychloride of the nuclides and the eutectic salt layer, uses two siphons to separate and collect the precipitate layer and the eutectic salt layer to a distiller and an eutectic salt collector respectively, reuses the eutectic salt of the separated and collected in an eutectic salt collector in the electro refining process, distills and condenses the separated and collected precipitate layer in the distiller having the condenser to back collect (recollection) the eutectic salt included in the precipitate layer, and reuses the recollected eutectic salt in the electro refining process.

BEST MODE FOR CARRYING OUT THE INVENTION

Figure 1:
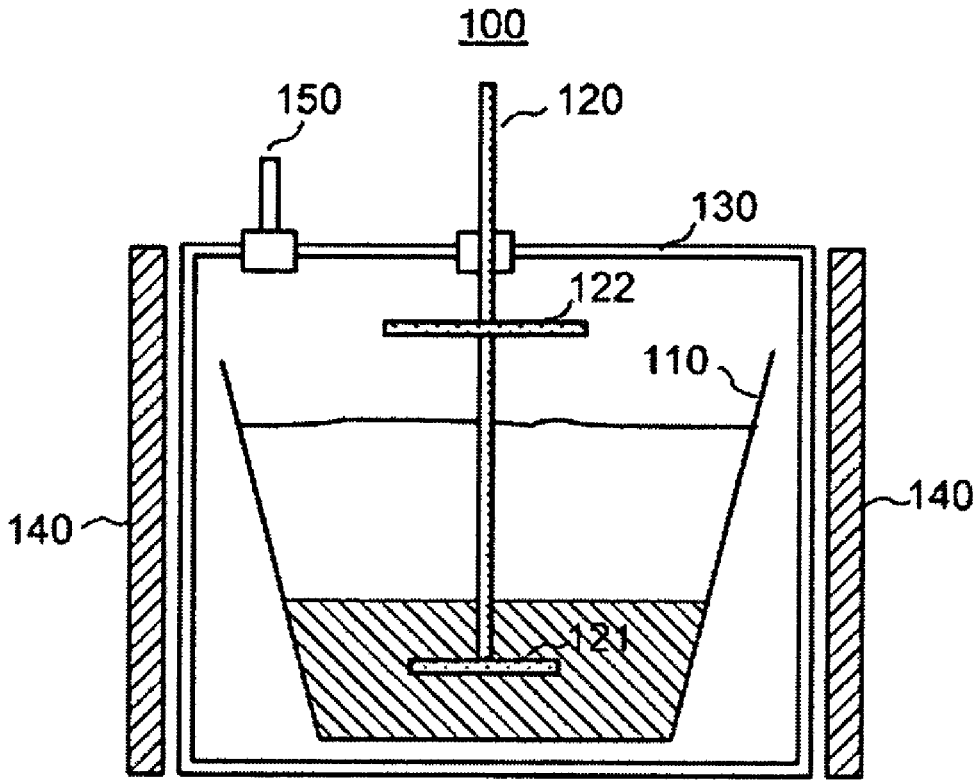
FIG. 1 is one configuration view of an oxidation apparatus of the present invention.

Hereinafter, preferred embodiments of the present invention will be described in detail with reference to the accompanying drawings. The following embodiments are provided as examples to fully transfer the ideas of the present invention to those skilled in the art. Therefore, the present invention is not limited to the following embodiments, but can be implemented with other forms. Also, the drawings may be exaggerated to better recognize the present invention. Furthermore, like components are denoted by reference numerals throughout the specification.

Figure 2:
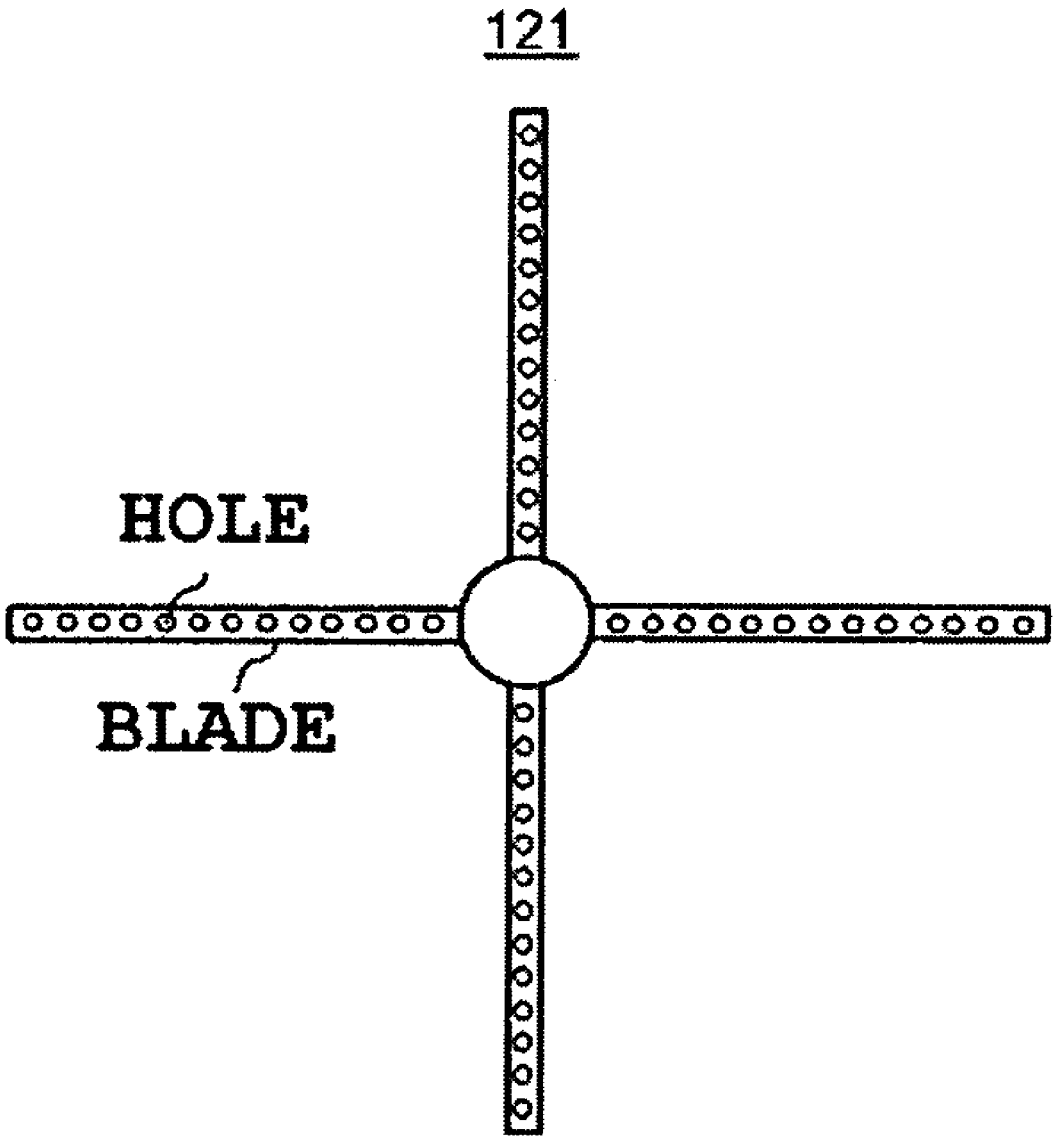
FIG. 2 is a view showing one example of a diffuser included in an oxygen supplying pipe of the present invention.

FIG. 1 shows an oxidation apparatus 100 of the present invention. The oxidation apparatus 100 includes a cone-type reactor 110 becoming narrow as going down, which is sealed with an airtight wall 130, an oxygen supplying pipe 120 having a diffuser 121 positioned at a lower surface of the reactor, and a gas discharging pipe 150, wherein a heater 140 is provided to the outside of the airtight wall. As shown in FIG. 2, the diffuser 121 is radially provided with four blades, which are formed with a plurality of holes discharging oxygen supplied from one side of the oxygen supplying pipe 120.

The oxidation apparatus of the present invention has the cone-type reactor becoming narrow as going down and introduces a porous (formed with holes) oxygen supplying pipe so that dispersion characteristic of oxygen within the eutectic salt waste is stabilized to disperse more oxygen flux, making it possible to reduce time reaching the conversion rate of 99.9% or more of the nuclides into the precipitates by about 30% and to minimize the discharge phenomenon of salt or produced rare earth and TRU oxide (or oxychloride) from largely and rapidly rising bubbles by the oxygen supplying pipe having the diffuser formed with the holes and a circular plate formed on the upper of the oxygen supplying pipe.

The present invention is to provide an apparatus of collecting the eutectic salt of the eutectic salt waste including the nuclides, the apparatus comprising the oxidation apparatus 100 of the present invention. The reuse apparatus of the eutectic salt waste of the present invention includes the oxidation apparatus 100, a distiller 200 having a condenser (not shown), an eutectic salt collector 300, a precipitate collecting pipe 400 whose one side is positioned at the base of the cone-type reactor 110 in the oxidation apparatus 100 and the other side is connected to the distiller 200, and an eutectic salt collecting pipe 500 whose one side is positioned higher than the precipitate collecting pipe 400 in the cone-type reactor 110 and the other side is connected to the eutectic salt collector 300.

The precipitate collecting pipe 400 and the eutectic salt collecting pipe 500 are a siphon. The precipitate collecting pipe 400 being the siphon and the eutectic salt collecting pipe 500 being the siphon separate and move the pure eutectic salt layer and the precipitate layer, which are separated within the reactor, by applying slight negative pressure to the siphons themselves.

Figure 3:
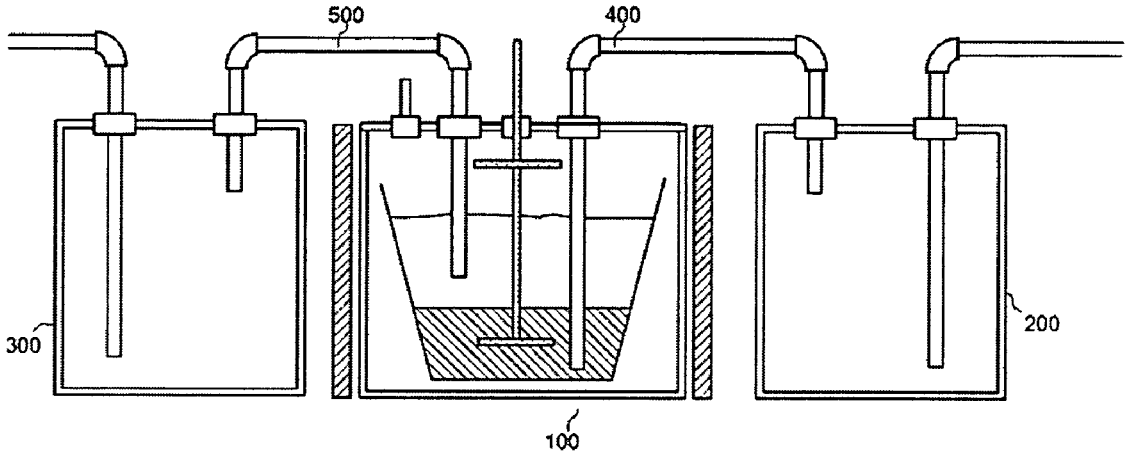
FIG. 3 is a view showing one configuration of a reuse apparatus of eutectic salt waste of the present invention.

FIG. 3 is one configuration example of the reuse apparatus of the eutectic salt waste of the present invention. In the oxidation apparatus 100 of FIG. 3, oxide, oxychloride, or oxide and oxychloride of the nuclides within the eutectic salt waste are produced and then leaved to leads to the layer separation of the precipitate layer of oxide, oxychloride, or oxide and oxychloride and the eutectic salt layer formed on the upper of the precipitate layer. The precipitate layer is separated and collected to the distiller 200 by the precipitate collecting pipe 400 and the eutectic salt layer is separated and collected to the eutectic salt collector 300 by the eutectic salt collecting pipe 500. At this time, the precipitate collecting pipe 400 whose the other side is connected to the precipitate collector (not shown) instead of the distiller 200 and the precipitate collector (not shown) is connected to the distiller 200, so that the precipitate layer is separated and collected to the precipitate collector (not shown) and is back moved, making it possible to perform the distillation of the precipitate layer in the distiller 200.

Since the precipitate layer includes the eutectic salt together with oxide, oxychloride, or oxide and oxychloride of the nuclides, to recollect the eutectic salt within the precipitate layer, the eutectic salt within the separated and collected precipitate layer by the distiller 200 is distilled and the distilled eutectic salt is condensed by the condenser (not shown), so that the eutectic salt within the precipitates is recollected.

Preferably, the eutectic salt waste including the nuclides used in the reuse apparatus and the reactor of the present invention is eutectic salt containing the nuclides including rare earth (Ce, Pr, Nd, Pm, Sm, Eu, Gd, Dy, Ho, Er, Tm, Yb, Lu), TRU (Np, Pu, Am, Cm), or a mixture thereof. Preferably, the eutectic salt is mixing salt of LiCl and KCl (LiCl=44.2 wt. %, KCl=55.8 wt. %).

The reuse apparatus of the eutectic salt waste according to the present invention can reuse 90% of salt existing in the eutectic salt waste, perform the layer separation by the free settling, perform the separation and collection using the siphons, and distill only the precipitate layer, thereby reusing salt at low cost, and can shorten time required for converting 99.9% of the nuclides within the eutectic salt waste into the precipitates, thereby increasing the collection efficiency of salt and making the compositions of the collected salt similar to the compositions of the salt used in the electro refining process.

A method of collecting the eutectic salt of the eutectic salt waste including the nuclides according to the present invention is proposed. At this time, the nuclides means rare earth (Ce, Pr, Nd, Pm, Sm, Eu, Gd, Dy, Ho, Er, Tm, Yb, Lu), TRU (Np, Pu, Am, Cm), or a mixture thereof. The eutectic salt is mixing salt of LiCl and KCl (LiCl=44.2 wt. %, KCl=55.8 wt. %). The reuse method of the eutectic salt waste of the present invention comprises the steps of: a) performing a layer separation into the precipitate layer of oxide, oxychloride, or oxide and oxychloride and the eutectic salt layer formed on the upper of the precipitate layer by producing and then leaving oxide, oxychloride, or oxide and oxychloride of the nuclides through the injection and heating of oxygen into the eutectic salt waste including the nuclides; b) separating and collecting the precipitate layer and the eutectic salt layer, respectively; and c) recollecting the eutectic salt by distilling the separated precipitate layer and condensing the distilled eutectic salt The core of the reuse method of the eutectic salt waste according to the present invention forms oxide, oxychloride, or oxide and oxychloride of the nuclides using oxygen, performs the layer separation (free settling) into the precipitate layer including oxide, oxychloride, or oxide and oxychloride of the nuclides and the eutectic salt layer using gravity, separates and collects the precipitate layer and the eutectic salt layer, respectively, by two siphons, reuses the eutectic salt of the separated and collected eutectic salt layer in the electro refining process, distills the separated and collected precipitate layer and condenses the distilled materials so that the eutectic salt included in the precipitate layer is back collected (recollected), and reuses the recollected eutectic salt in the electro refining process.

Preferably, the oxidation of the nuclides is performed at a temperature of 600 to 700° C. In other words, to optimize the oxidation of the nuclides, preferably, oxide, oxychloride, or oxides and oxychloride are produced at a temperature of 600 to 700° C. The oxidation reaction does not occurs actively at a temperature of 600° C. or less so that time required for oxidizing 99.9% of the nuclides is too long and the volatilization phenomenon of the eutectic salt may occur at a temperature of 700° C. or more and the corrosion phenomenon may be accelerated due to a relatively high temperature.

Preferably, the distillation step c) is distilled at a temperature of 800 to 1000° C. under a pressure of 0.1 to 100 torr. The pressure range and the temperature range are the optimized temperature and pressure ranges to allow the the eutectic salt contained in the precipitates to have high purity and to obtain the compositions suitable for the reuse.

Embodiment 1

When oxygen of 1.5 liter/min is dispersed into the eutectic salt waste (500 g) including the rare earth nuclides for 300 minutes at a temperature of 650° C., the conversion rate of the nuclides into the precipitates is indicated in table 1.

TABLE 1

| $RECl_3$ | T(° C.) 650 |
|---|---|
| $EuCl_3$ | >99.9 |
| $NdCl_3$ | >99.9* |
| $CeCl_3$ | >99.9* |
| $PrCl_3$ | >99.9* |

It can be appreciated from table 1 that all rare earth nuclides have the conversion ratio of 99.9% or more at a temperature of 650° C. under the oxygen dispersion condition for 300 minutes. Ce and Eu are oxidized into oxide and Nd is oxidized into oxychloride and Pr exists in oxide and oxychloride together. Meanwhile, since Ce is generally used as a substitution material of TRU element (Hee-Chul Yang et al., Journal of the Korean Nuclear Society, vol. 34, No. 1, 80-89 (2002); A. S. Wang et al., Journal of Nuclear Materials, vol. 265, 295-307 (1999); T. Katawa et al., First OECD/NEA information Exchange Meeting on Separation and Transmutation of Actinides and Fission Products, Mite, Japan, November 6-9 (1990)), it is expected that the use of the reuse method of the eutectic salt waste of the present invention converts 99.9% or more of TRU element into oxide.

After oxygen of 1.5 liter/min is dispersed into the LiCl—KCl eutectic salt waste (500 g) including the rare earth nuclides for 300 minutes at a temperature of 650° C., it leaves in a molten state for 6 hours to perform the layer separation into the pure salt layer of the upper and the precipitate layer of the lower by the free settling. At this time, the pure eutectic salt is moved to a well polished SUS vessel using the siphons and is then cooled. About 60% of the pure eutectic salt included in the eutectic salt waste can be collected and reused by the layer separation and the siphons. The precipitate layer is made of rare earth precipitate (Ce oxide, Eu oxide, Nd oxyoxide, Pr oxide and Pr oxychloride) and the remaining pure eutectic salt. The precipitate layer is moved to the distillation apparatus using the other siphon and is distilled under the conditions of a pressure of 5 torr and a temperature of 900° C. and then the distilled eutectic salt is cooled in a cooler, making it possible to collect and reuse about 40% of the pure eutectic salt included in the eutectic salt waste. The following table 2 indicates (ppm in unit) the analysis results of the composition of the eutectic salt collected by distilling the precipitate layer and then condensing it in the cooler. It can be appreciated from the following table 2 that there is no the rare earth elements within the eutectic salt collected by the distillation/condensation and the eutectic composition is the same as the first composition. A filter of the following table 2, which is a filter included in the distiller, is a filter installed following the condenser not to discharge salt to the outside, wherein the salt is distilled and is then not condensed in the condenser

TABLE 2

| Part Elements | Condenser (ppm) | Filter (ppm) | Limit detection (ppm) |
|---|---|---|---|
| Ce | ND | ND | 0.01 |
| Eu | ND | ND | 0.01 |
| Nd | ND | ND | 0.01 |
| Pr | ND | ND | 0.02 |
| Li (LiCl wt. % conversion) | 65.6 (48.4) | 64.7 (39.8) | Average of condenser and filter: 44.1 |
| K (KCl wt. % conversion) | 225 (51.6) | 315 (60.2) | Average of condenser and filter: 55.9 |

*mixing ratio of eutectic salt (LiCl:KCl wt. % ratio 44.23:55.77)

As can be appreciated from the embodiment 1, the reuse method of the eutectic salt waste of the present invention leads to the oxidation of the nuclides within the eutectic salt waste using oxygen, making it possible to oxidize 99.9% of the nuclides into oxide, oxychloride, or oxide and oxychloride within very rapid time, primarily collects the eutectic salt using the siphons after the layer separation by the free settling, collects and reuses 90% or more of the eutectic salt within the waste by distilling the precipitates and secondarily collecting the eutectic salt, and allows the compositions of the collected eutectic salt to have the same composition as the eutectic salt used in the electro refining process.

INDUSTRIAL APPLICABILITY

The reuse apparatus of the eutectic salt waste and the method thereof according to the present invention can reuse 90% or more of salt existing in the eutectic salt waste, perform the layer separation by the free settling, perform the separation and collection using the siphons, and distill only the precipitate layer, thereby reusing the salt at low cost and can shorten time required for converting 99.9% of the nuclides within the eutectic salt waste into the precipitates, thereby increasing the collecting efficiency of salt and allowing the compositions of the collected eutectic salt to have the same compositions as the eutectic salt used in the electro refining process.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims

The invention claimed is:

1. A reuse method of eutectic salt waste including nuclides comprising the steps of:

a) producing oxychloride, or oxide and e of nuclides through injection and heating of oxygen into the eutectic salt waste including the nuclides;

b) performing a layer separation into a precipitate layer of oxide, oxychloride, or oxide and oxychloride and an eutectic salt layer formed on the upper of the precipitate layer by using free settling;

c) separating and collecting the precipitate layer and the eutectic salt layer, respectively;

d) recollecting the eutectic salt by distilling the separated precipitate layer and condensing the distilled eutectic salt; and e) reusing the eutectic salt collected from step (c) and the eutectic salt recollected in step (d) in an electro refining process of nuclear fuel.

2. The method as set forth in claim 1, wherein oxide, oxychloride, or oxide and oxychloride of the nuclides of the step a) are produced at a temperature of 600 to 700° C.

3. The method as set forth in claim 1, wherein the separation and collection of the step c) uses siphons.

4. The method as set forth in claim 1, wherein the distillation of the step d) is distilled at a temperature of 800 to 1000° C. under a pressure of 0.1 to 100 torr.

* * * * *